United States Patent [19]

Zimmer et al.

[11] 3,947,060

[45] Mar. 30, 1976

[54] BOLT MECHANISM WITH MANUAL OVERRIDE

[75] Inventors: Russell D. Zimmer; William S. Traver, both of Colchester, Ill.

[73] Assignee: Pulse Dynamics Manufacturing Corporation, Colchester, Ill.

[22] Filed: Feb. 26, 1975

[21] Appl. No.: 553,383

[52] U.S. Cl. ..... 292/142; 70/279; 292/144

[51] Int. Cl.[2] ..... E05B 47/00

[58] Field of Search ..... 70/92, 279, 280; 292/144, 292/201, 142, 92

[56] References Cited

UNITED STATES PATENTS

| | | | |
|---|---|---|---|
| 2,070,803 | 2/1937 | Oblak | 292/144 |
| 3,425,742 | 2/1969 | Rauber | 296/121 |
| 3,548,619 | 12/1970 | Purdy | 70/267 |
| 3,854,310 | 12/1974 | Paull | 70/280 |

*Primary Examiner*—Albert G. Craig, Jr.
*Attorney, Agent, or Firm*—Reising, Ethington, Barnard, Perry & Brooks

[57] ABSTRACT

A bolt mechanism of the disclosure has a bolt driven between latching and non-latching positions by a rotary electric motor through a speed reduction gear drive train which includes a slip clutch that permits the bolt to be manually moved from either position thereof to the other in a manner overriding the drive train and the motor. The electric motor is of the DC type, and an electrical control circuit therefor reverses polarity and terminates the motor operation as the bolt moves to either of its positions so that subsequent normal motor operation is in a reverse direction to drive the bolt to the other position. A recess in the bolt receives an output gear of the drive train as well as an elongated gear rack fixedly mounted with respect to the bolt and meshed with the output gear to provide the bolt movement during motor operation. A handle mounted on the bolt is manually grasped to provide the overriding movement of the bolt.

9 Claims, 8 Drawing Figures

BOLT MECHANISM WITH MANUAL OVERRIDE

BACKGROUND OF THE INVENTION

1. Field of the Invention

This invention relates generally to bolt mechanisms for providing a latching function, and more particularly toward such mechanisms wherein the bolt thereof is driven by an electric motor between latching and non-latching positions.

2. Description of the Prior Art

Electrically operated bolt mechanisms whose bolts are driven by electric motors between latching and non-latching positions have been known for quite some time. Usually, such bolt mechanisms utilize a linear electric motor of the solenoid type whose armature is connected to the bolt and reciprocated within a field core that controls the armature and bolt position. Such linear electric motors have a limited extent of travel since the armature cannot move out of the core and still be controlled by the magnetic field the core generates. Also, this type of linear electric motor requires a surge of electric current when the core is energized to generate the magnetic field that moves the armature.

Electrically operated bolt mechanisms or locking mechanisms for such bolt mechanisms have also utilized rotary electric motors for providing driving movement. For example, see U.S. Pat. Nos.: 2,090,520; 2,922,672; 2,943,880; 3,157,042; and 3,541,874.

One type of electric motor driven bolt mechanism that has been used in the past utilizes a bolt which is spring biased toward its latching position and has an inclined edge that is engaged by a keeper to momentarily move the bolt to its non-latching position against the spring bias, and the bolt is then moved by its spring bias to the latching position to engage the keeper in a latching relationship. Such a bolt mechanism is not capable of having an electric motor provide the primary impetus for bolt movement from either of its positions to the other since the spring bias of the bolt moves it in one of its directions of travel. The motor thus only provides the impetus for moving the bolt in one direction of travel while the spring bias provides the impetus in the other.

SUMMARY OF THE INVENTION

An object of the present invention is to provide a bolt mechanism having an unbiased bolt that is normally driven between latching and non-latching positions by a rotary electric motor through a speed reduction gear drive train, and also incorporating a slip clutch along the path of driving engagement between the motor and the bolt so that the bolt may be manually moved from one position thereof to the other in a manner overriding the drive train and the motor.

Another object of the invention is to provide a bolt mechanism having a bolt that fixedly mounts an elongated gear rack and is driven between latching and non-latching positions by a rotary electric motor through a speed reduction gear drive train whose input gear is driven by the motor and whose output gear engages the elongated gear rack on the bolt.

The preferred embodiment of the bolt mechanism utilizes a DC type electric motor energized by an electrical control circuit that reverses polarity and terminates the motor operation as the bolt moves to either position thereof so that subsequent normal motor operation is in the opposite direction to drive the bolt to the other position. Also, the gear rack is fixedly mounted on the bolt within a recess in the bolt, and this recess also receives an output gear of the speed reduction gear drive train. The slip clutch is located between the input and output of the speed reduction gear drive train, and a handle mounted to the bolt permits the overriding bolt movement as the handle is manually grasped and moved.

Other objects, features and advantages of the invention will become readily apparent from the following detailed description of the preferred embodiment taken in connection with the accompanying drawings.

DETAILED DESCRIPTION OF THE PREFERRED EMBODIMENT

Figure 1:
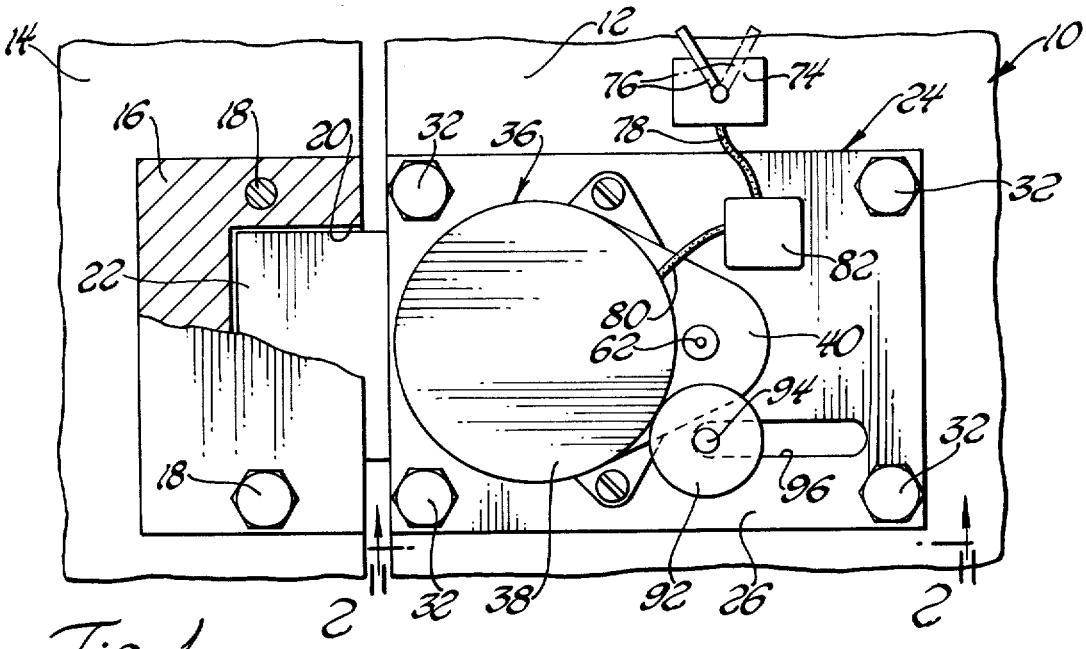
FIG. 1 is a top plan view showing a bolt mechanism constructed according to the present invention with the bolt thereof shown in a latching position.

With reference to FIG. 1 of the drawings, a bolt mechanism constructed according to the present invention is collectively indicated by reference numeral 10 and is mounted on a fixed member 12 adjacent a movable closure member 14. A keeper 16 is secured to the closure member 14 by bolts 18 and defines an opening 20 that faces the bolt mechanism 10. A bolt 22 of the bolt mechanism is movable into the keeper opening 20 to thereby latch the closure member 14 in the closed position shown with respect to the fixed member 12. Movement of the bolt 22 to the right retracts the bolt 22 from the keeper opening 20 to permit movement of closure member 14 to an open position. The respective positions of the bolt mechanism 10 and the keeper 16 on the fixed member 12 and the movable closure member 14 may be reversed from that shown without inhibiting the latching function that is provided by their cooperative action.

With additional reference to FIGS. 2 and 3, the bolt mechanism 10 includes a housing collectively indicated by reference numeral 24 and consisting of upper and lower plates 26 and 28 above and below bolt 22. A pair of elongated bars 30 are positioned on opposite sides of bolt 22, and a number of threaded bolts 32 extend through the plates 26 and 28 as well as throughh the bars 30 and are received by nuts 34 to provide securement of the housing components to each other. The bolt 22 is supported by the housing 24 for sliding movement in a rectilinear path between the extended latching position shown in FIGS. 1 and 2 and a retracted non-latching position where the bolt is located through within the housing.

Figure 6:
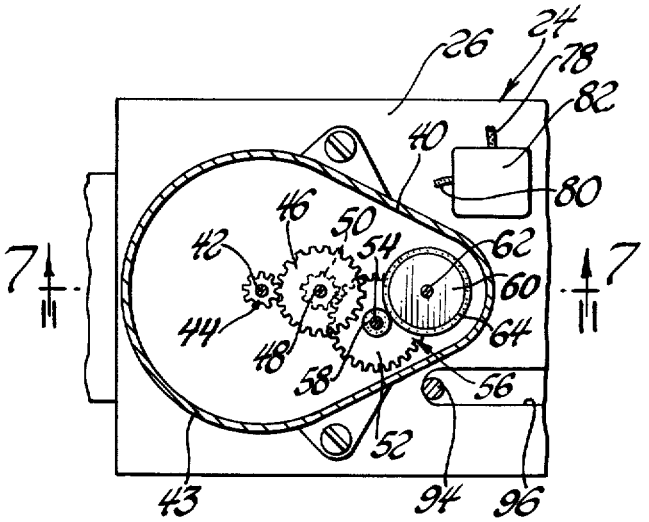
FIG. 6 is a sectional view taken along line 6—6 of FIG. 2 showing a speed reduction gear drive train that extends between the electric motor and the bolt, and also shows a slip clutch which permits the bolt movement to be manually overridden.
Figure 7:
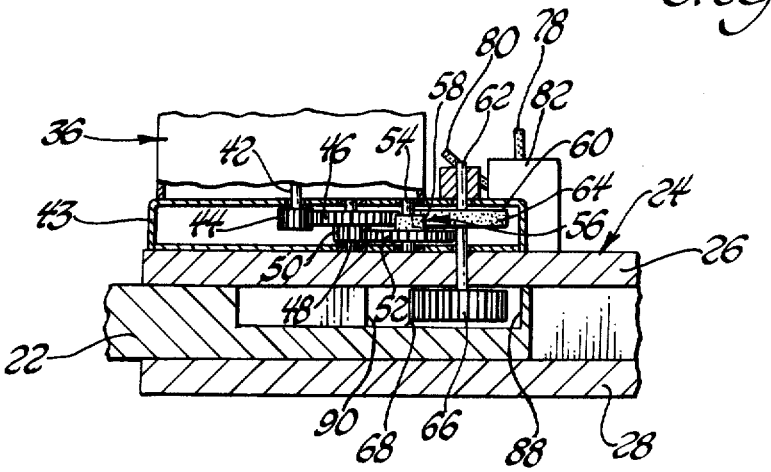
FIG. 7 is a side view of the gear drive train taken along line 7—7 of FIG. 6.

A drive unit indicated collectively by reference numeral 36 is mounted on top of the upper plate 26 of the mechanism housing and includes a DC electric motor 38 mounted on top of a speed reduction gear drive train 40. As seen in FIGS. 6 and 7, a shaft 42 of motor 38 extends downwardly into a housing 43 of the gear drive train and carries a small pinion gear 44 that functions as an input gear of the drive train. A larger gear 46 is carried by a shaft 48 supported by housing 43 and is meshed with gear 44 so as to be driven during the motor shaft rotation. A smaller gear 50 is also mounted on shaft 48 and rotatably fixed to gear 46 so as to likewise rotate during motor shaft rotation. A larger gear 52 is supported by a shaft 54 mounted on the housing 43 and is driven by gear 50 during the motor operation.

A slip clutch of gear drive train 40 is generally indicated by 56 and includes a small rubber hub 58 mounted on shaft 54 and rotatably driven along with the gear 52. A larger driven member 60 of the slip clutch is mounted on a shaft 62 supported by the housing 43 and includes an outer annular rubber ring 64 that is driven by the hub 58. The rubber ring 64 on the driven member 60 of the clutch and the rubber hub 58 engage each other with a force that normally maintains a driving relationship between these components. However, this engagement force between the two components of the clutch 56 is not so large as to prevent slippage when the gear drive train is driven in a reverse manner during overriding actuation of the bolt mechanism 10 in a manner that will be described later. The shaft 62 of the drive train extends downwardly and connects the driven member 60 of clutch 56 to an output gear 66 as seen in FIG. 7.

Figure 4:
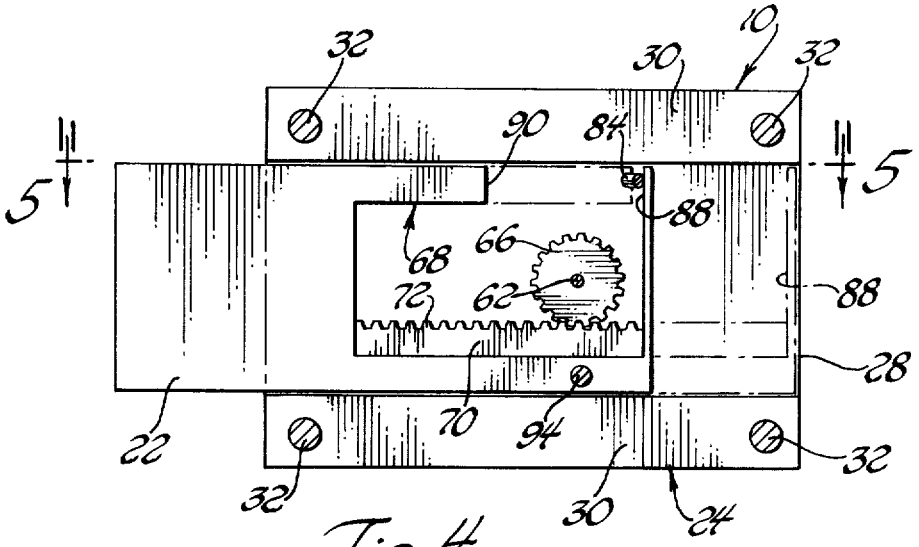
FIG. 4 is a sectional view of the bolt mechanism taken along line 4—4 of FIG. 2 and shows the bolt in the solid line indicated latching position as well as the phantom line indicated non-latching position.
Figure 5:
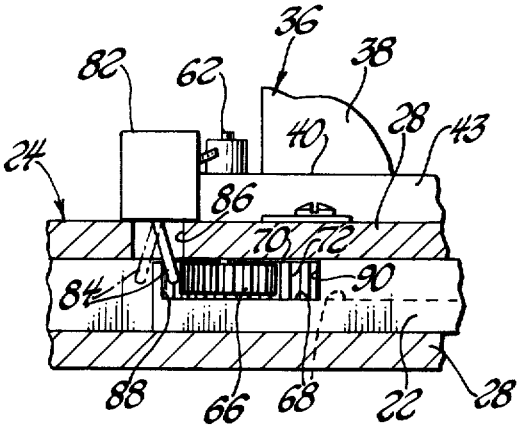
FIG. 5 is a sectional view of the bolt mechanism taken along line 5—5 of FIG. 4 and shows a switch which is responsive to movement of the bolt to each of its positions to function as part of an electric control circuit that energizes the motor.

With reference to FIGS. 4 and 5, the bolt 22 defines a recess 68 that receives the output gear 66 of the speed reduction gear drive train 40. An elongated gear rack 70 is also received within the bolt recess 68 and is fixedly mounted to the bolt in a suitable manner so as to be aligned with the direction of bolt movement. The gear rack 70 includes teeth 72 that mesh with the teeth of the output gear 66 of the reduction gear drive train so that the bolt is driven between its FIG. 4 solid line indicated latching position and its retracted phantom line indicated non-latching position in accordance with the direction of output gear rotation. The gear rack 70 is thus elongated in a rectilinear manner so that its driven movement likewise slides the bolt 22 in a rectilinear manner between its latching and non-latching positions.

Figure 3:
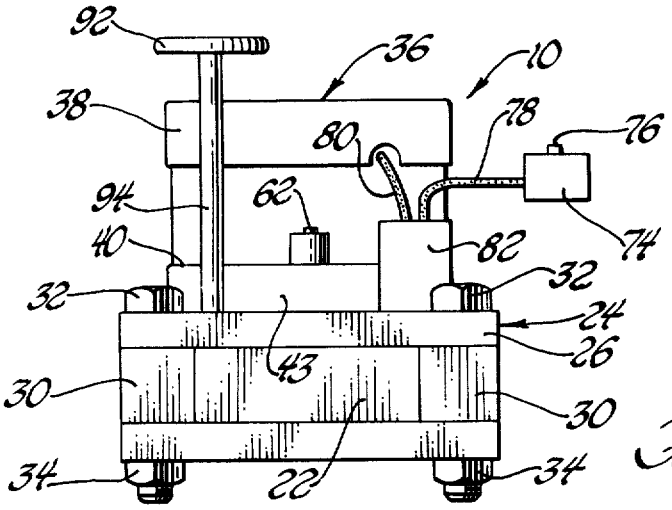
FIG. 3 is an end view of the bolt mechanism taken along line 3—3 of FIG. 2.

As seen in FIGS. 1 and 3, a control panel 74 includes a two-position switch 76 and is connected to the electric motor 38 by wire conduit bundles 78 and 80 through a control switch 82 mounted on the upper plate 26 of the bolt mechanism housing in any suitable manner. The control switch 82, as seen in FIG. 5, includes an arm 84 that extends downwardly through an aperture 86 in the upper housing plate 26 and is received between a pair of control surfaces 88 and 90 of the bolt recess 68. The switch arm 84 is moved to its solid line indicated and phantom line indicated positions by the control surfaces 88 and 90 on bolt 22 as the bolt moves to its latching and non-latching positions, respectively, to control the motor operation. The switch 82 has a center bias that normally positions its arm 84 in a center position between the two positions shown in FIG. 5 when the bolt is moving between its latching and non-latching positions to function in a manner that will be hereinafter described.

Figure 2:
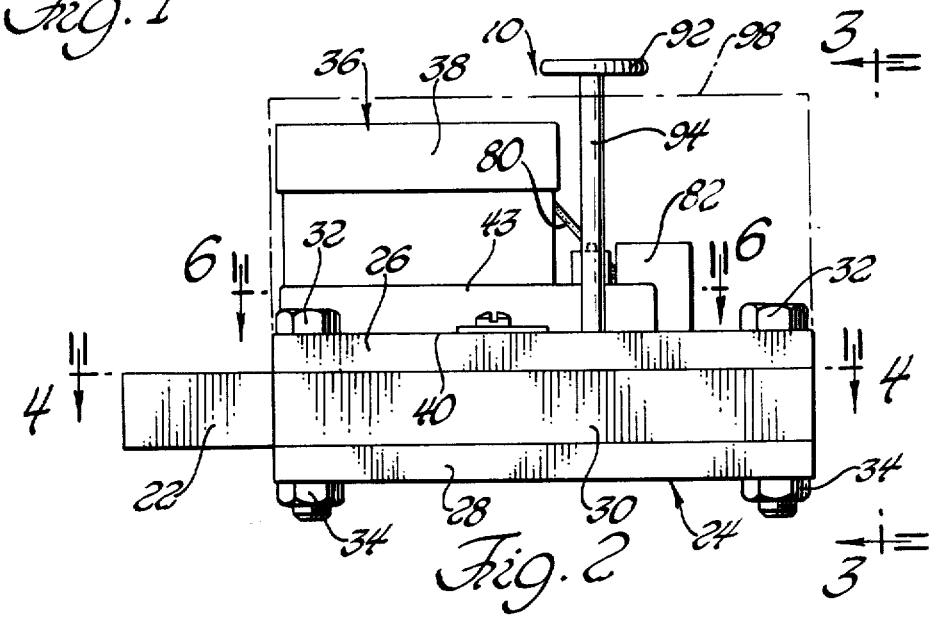
FIG. 2 is a side view of the bolt mechanism taken along line 2—2 of FIG. 1.

An override handle of the bolt mechanism 10 is indicated by reference numeral 92 in FIGS. 1 - 3 and includes a shaft 94 extending downwardly through an elongated slot 96 in the upper housing plate 26. The lower end of the handle shaft 94 is threaded into the bolt 22 at a location adjacent the gear rack 70 as can be seen in FIG. 4. When an operator desires to rapidly move the bolt 22 from one position thereof to the other, the override handle 92 is manually grasped and moved in an appropriate direction so that the handle shaft 94 moves from one end of the housing slot 96 to the other and thereby moves the bolt to the desired position. The slip clutch 56 of the gear drive train 40 permits a slipping action to occur between the rubber hub 58 and the rubber ring 64 on the driven member 60 while the rapid overriding bolt movement takes place. This overriding bolt movement thus takes place without having to drive the complete inertial mass of the motor in a reverse direction through the drive train throughout the full length of bolt movement. The engagement of the components of slip clutch 56 is, however, sufficiently large so that the inertial mass of the motor and drive train normally positions the bolt 22 in either of its positions without any biasing means urging the bolt to one position or the other. Engagement between the handle shaft 94 and the opposite ends of housing slot 96, see FIG. 1, provides a mechanical stop as the bolt is driven to either of its positions or manually moved in the overridden manner.

The bolt mechanism 10 may also include a trim housing 98, as shown in phantom lines in FIG. 2, which encloses the upper portion of the bolt mechanism and provides an esthetically appealing appearance. This trim housing must, of course, define an elongated slot aligned with the slot 96 in the upper housing plate 26 so as to permit movement of the shaft 94 of the manual override handle 92 during the manually actuated overriding bolt movement.

Figure 8:
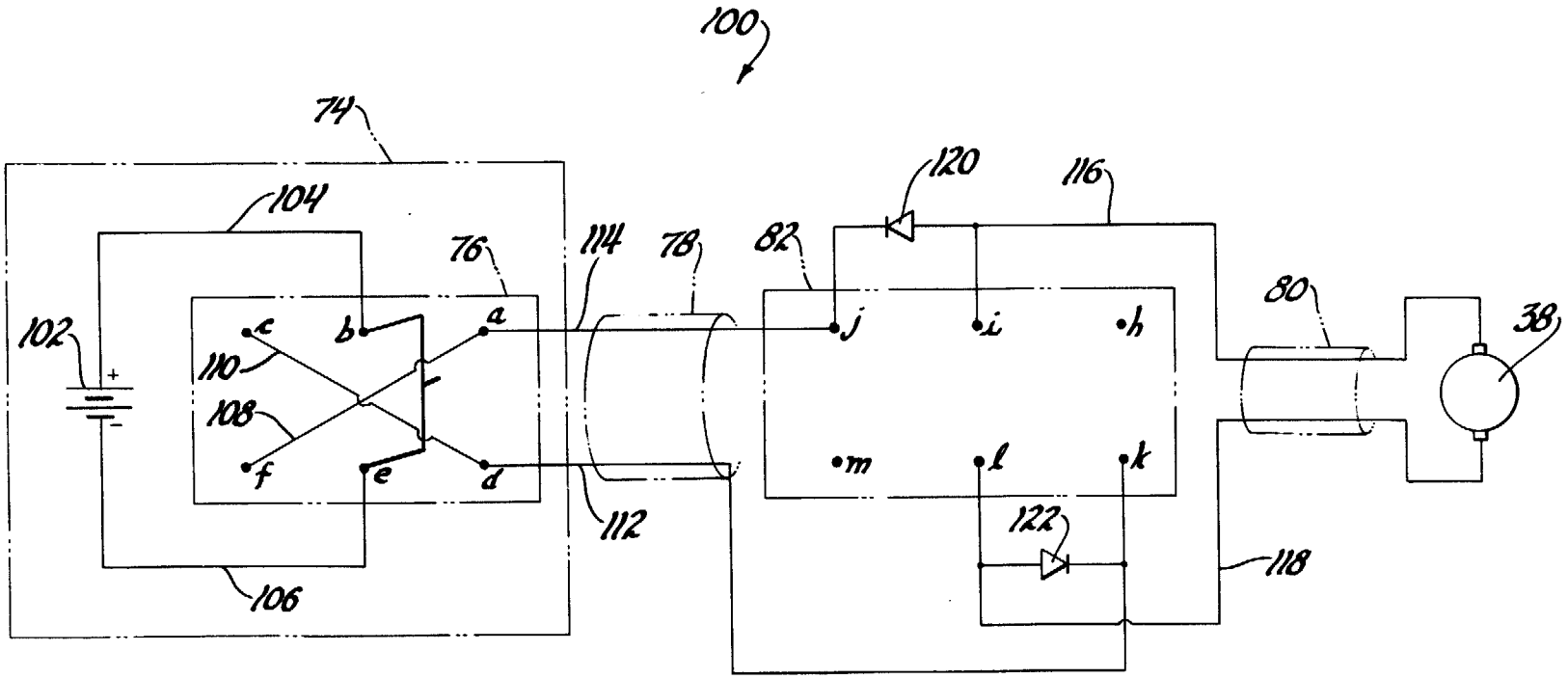
FIG. 8 is a view showing an electrical circuit that controls the motor operation.

FIG. 8 shows an electrical control circuit for the bolt mechanism, the circuit being collectively indicated by reference numeral 100. The control panel 74 of the circuit has a source of DC power 102, such as a battery, that is connected by wires 104 and 106 to the two-position switch 76. Switch 76 has contacts *a*, *b*, *c*, *d*, *e* and *f*, the contacts *b* and *e* being respectively connected to wires 104 and 106, and the contact pairs *a–f* and *c–d* being connected by respective crossing wires 108 and 110. One position of switch 76 connects contacts *b* and *c* and contacts *e* and *f* to send a positive current to a wire 112 connected to contact *d*, as well as sending a negative current to a wire 114 connected to contact *a*. The other position of switch 76 connects contacts *b* and *a* and contacts *e* and *d* to send a positive current to wire 114 and a negative current to wire 112.

Wires 112 and 114 of circuit 100 are carried by wire bundle 78 to the switch 82 whose control arm 84 is not shown in FIG. 8. Switch 82 has contacts *h*, *i*, *j*, *k*, *l*, and *m*. Contacts *j* and *k* respectively connect wires 114 and 112 extending from the control panel 74. Switch 82 per se is of a commercially available type such that when its arm 84, FIG. 5, is in its center position to which it is normally biased, the contacts *i* and *j* are connected as are contacts *l* and *k*. This center position of switch 52 is made when the bolt 22 is in transit being driven from one position thereof to the other. Wires 116 and 118 are respectively connected to contacts *i* and *l* of switch 82 and to motor 38. While the bolt 22 is in transit with the switch 82 in its center position, the direction the motor is driven corresponds with the polarity supplied to it by switch 76 which is determined by the position of the latter switch. As the bolt 22 moves to its latching or nonlatching position, the switch arm 84 of switch 82 is moved from its center position to one of the positions shown in FIG. 5. This switch arm movement breaks the connection of contact *i* with contact *j* if the bolt moves to the nonlatching position and connects contact *j* with contact *h*. If the bolt moves to the latching position, the switch arm movement breaks the connection of contact *l* with contact *k* and connects contact *l* to contact *m*. Consequently, the path of current for energizing motor 38 is broken when the bolt reaches either its latching or nonlatching position. Diode 120 permits current to pass in one direction from contact *i* to contact *j* of switch 82 and diode 122 permits current to pass in one direction from contact *l* to contact *k* of this switch. These diodes thus provide an initial path for current to flow through upon a reversal of switch 76 prior to the arm of switch 82 moving to its center position, but the diodes block the current flow in the opposite direction. Thus, as the bolt moves into either its latching or nonlatching position, the diodes prevent the concomitant switching of the interconnected contact pairs of switch 82 from energizing the motor to drive the bolt to the other position. The motor 38, therefore, does not oscillate and drive the bolt 22 back and forth between its latching and nonlatching positions, but rather must wait for the switch 76 to be moved from the position it is in to the other so the polarity of current supplied to switch 82 is reversed to then begin driving of the bolt to the other position.

The operation of motor 38 is thus terminated by switch 82 as the bolt 22 moves to either its latching or nonlatching positions, and the supply polarity from switch 76 must be reversed to drive the bolt back to the other position. However, should the bolt 22 be manually moved in its overridden manner to the other position, engagement of control surface 88 or 90 on the bolt with the switch arm 84 of switch 82 causes the switch 82 to energize the motor 38 and drive the bolt back to its original position occupied prior to the overriding bolt movement, this being done without any movement of switch 76. If the overriding bolt movement carries the bolt less than all the way to the other position, the switch arm 84 of switch 82 is in its center position and drives the motor 38 according to the polarity supplied by switch 76, which moves the bolt back to the position it was in prior to the overriding movement.

While a specific embodiment of the invention has been described, those skilled in the art will recognize various modifications and alternatives that may be used while still remaining within the scope of the invention as defined by the following claims.

What is claimed is:

1. A bolt mechanism comprising the combination of: a unitary bolt movable between latching and non-latching positions and being unbiased toward either position; said bolt including a pair of spaced control surfaces; a rotary DC electric motor having a rotatable shaft; a speed reduction gear drive train having an input driven by the motor shaft and an output drivingly engaged with the bolt so as to drive the bolt from one position thereof to the other as the motor shaft rotates; control circuit means for reversing the direction the bolt is driven by the motor and gear drive train so that the bolt may be driven to either the latching or nonlatching position; said control circuit means including a switch having an arm received between the control surfaces of the bolt and engaged by one of said surfaces as the bolt moves to each of its positions so as to reverse the polarity supplied to the motor by the circuit means; and slip clutch means along the path of driving engagement between the motor shaft and the bolt so the bolt is normally located in either position thereof by the motor and drive train but may be manually moved from one position thereof to the other in a manner overriding the motor and drive train.

2. A bolt mechanism according to claim 1 wherein the slip clutch means is located between the input and output of the speed reduction gear drive train.

3. A bolt mechanism according to claim 1 wherein an elongated gear rack is fixedly mounted on the bolt and engaged by a gear at the output of the speed reduction gear drive train so as to be driven between the latching and non-latching positions.

4. A bolt mechanism according to claim 3 wherein the bolt moves along a rectilinear path and the gear rack is elongated in a rectilinear manner along said path.

5. A bolt mechanism according to claim 3 wherein the bolt defines a recess in which the elongated gear rack is mounted and the gear at the output of the gear drive train is also received within the recess to mesh with the gear rack.

6. A bolt mechanism according to claim 1 wherein the bolt control surfaces that actuate the control circuit means as the bolt moves to the latching or nonlatching position are arranged in an opposed relationship to each other with the switch arm therebetween.

7. A bolt mechanism according to claim 1 wherein the control switch arm pivots upon being engaged by either of the control surfaces on the bolt.

8. A bolt mechanism according to claim 1 wherein a handle is fixedly mounted on the bolt and manually grasped to provide the bolt movement in the overridden manner.

9. A bolt mechanism comprising: a bolt movable between latching and nonlatching positions and being unbiased toward either position; said bolt including a pair of spaced control surfaces; an elongated gear rack fixedly mounted on the bolt; a rotary electric motor of the DC type having a rotatable shaft; a speed reduction gear drive train having an input gear driven by the motor shaft and an output gear meshing with the gear rack to drive the bolt from one position thereof to the other as the motor shaft rotates; a control circuit that terminates the motor operation when the bolt moves to either position and concomitantly reverses its polarity so that subsequent motor shaft rotation will be in a reverse direction to drive the bolt to the other position; said control circuit including a switch having an arm received between the control surfaces of the bolt and engaged by one of said surfaces as the bolt moves to each of its positions so as to reverse the polarity supplied to the motor by the circuit; and slip clutch means located between the input and output gears of the reduction gear drive train so the bolt is normally located in either position thereof by the motor and drive train but may be manually moved from either position to the other in a manner overriding the motor and drive train.

* * * * *